United States Patent [19]

Chan et al.

[11] 4,039,822

[45] Aug. 2, 1977

[54] CIRCULAR RECESSED LIGHTING FIXTURE

[75] Inventors: Kingsley Chan, Rutherford; Neil Russo, Jersey City, both of N.J.

[73] Assignee: Lightolier Incorporated, Jersey City, N.J.

[21] Appl. No.: 683,257

[22] Filed: May 5, 1976

[51] Int. Cl.[2] ..... F21S 5/00

[52] U.S. Cl. ..... 240/73 BC; 240/2 W; 240/78 H; 240/78 HA; 240/130

[58] Field of Search ..... 240/2 W, 73 R, 73 BC, 240/73 QD, 78 R, 78 H, 78 HA, 52 R, 52.1, 130, 131, 134

[56] References Cited

U.S. PATENT DOCUMENTS

| | | | |
|---|---|---|---|
| 1,769,481 | 7/1930 | Zahm | 240/130 |
| 2,741,695 | 4/1956 | Schockett | 240/73 BC |
| 3,375,368 | 3/1968 | Dorsky | 240/78 H |
| 3,697,742 | 10/1972 | Bobrick | 240/73 BC |
| 3,872,296 | 3/1975 | Cohen et al. | 240/73 BC |

*Primary Examiner*—Russell E. Adams
*Attorney, Agent, or Firm*—Arthur B. Colvin

[57] ABSTRACT

The present invention is directed to an improved recessed lighting fixture for flush mounting in a hung ceiling structure or the like. The fixture is characterized by its ability to be securely anchored in position, yet be readily removed from a position below the ceiling for the changing of bulbs, replacement of electrical connections, etc. The apparatus includes a frame permanently mounted above the ceiling, installation of the reflector and attached light source components being effected by simple vertical movement of the reflector assembly. Removal of the reflector assembly from the frame is accomplished by a relative rotation of the reflector and frame.

7 Claims, 6 Drawing Figures

2
12
13
11
14
33
34
32
31
35
51
2
12
22
39
38
3
3
30
29
36
15
16
17
18
21
19
20
28
28
26
27
24
23
25
26
27
24
25

CIRCULAR RECESSED LIGHTING FIXTURE

BACKGROUND OF THE INVENTION

1. Field of the Invention

The present invention is in the field of lighting fixtures, and particularly lighting fixtures intended to be used in so-called hung ceiling installations.

2. The Prior Art

In a conventional hung ceiling lighting installation, a structural support element or frame is mounted above the ceiling. A reflector assembly including a light source at its upper end is arranged to be secured to the frame. In order to change bulbs, make repairs to electrical components of the assembly, or gain access to the space behind the ceiling, it is necessary or desirable that the reflector-light assembly be removable in a downward direction from a position below the ceiling.

Heretofore, in lighting fixtures of this type, the reflector assembly and frame were provided with interfitting detents, slots and like fastening expedients which required, for installation, an accurate positioning of the respective components carried by the frame and reflector assembly. In the event the frame were installed improperly, i.e. if the spacing of the frame from the ceiling were greater or less than intended, the reflector would fail to seat firmly against the ceiling or might hang a distance below the ceiling.

In order to minimize defects of prior devices of this type, a lighting fixture in accordance with U.S. Pat. No. 3,872,296 was devised. In accordance with such device, the aperture in the ceiling through which the reflector assembly is to be mounted was framed about by a bezel fixed to the frame, the bezel including portions which underlap the ceiling. The reflector assembly included spring members having cam portions which coact with the bezel to maintain the reflector assembly in position.

While the noted patent represents a substantial advance in the art, it does not, after mounting of the frame, provide as full a range of weightwise adjustment of the reflector as might be desirable. Further, if the spring force exerted by the above referred to support members was too great, a good deal of difficulty was experienced in removing the reflector from its mounted position in the ceiling. If, on the other hand, the supporting spring force was reduced to facilitate removal, there occasionally existed, especially upon improper installation, a tendency for the reflector to sag, leaving a space between the flange of the reflector and the ceiling.

SUMMARY

The present invention may be summarized as directed to an improved lighting fixture for hung ceiling installations characterized by providing a firm interconnection between the reflector assembly and the supporting frame, the reflector being readily removable from its mounted association with the frame from a position beneath the ceiling. The connection between the reflector and frame further provides a substantial range of adjustment so as to compensate for relatively large errors in installation of the frame, including heightwise and angular errors.

The device is characterized by the frame including a series of spring elements mounted thereon having free end portions which project inwardly into the path of the reflector member as the same is inserted into position. The spring elements include inclined lips or barbs which are angularly related to the horizontal and define, in essence, short segments of helices having a common pitch and inclination and being located in coplanar alignment.

The lips support the reflector by engagement with an external surface of the same. The substance of which the reflector is fabricated, normally aluminum, is substantially softer than the material of which the springs and lips are fabricated, normally hardened spring steel. As the lips may bite into any of a series of vertically displaced portions of the reflector, depending upon the degree to which and angle at which the reflector is inserted, a substantial range of heightwise and tilting adjustment of the reflector relative to the frame is possible.

In order to remove the reflector, it is merely necessary to rotate the same in the direction of inclination of the lips. The harder lip portions which have supported the reflector by biting into the substance thereof will cause the reflector to be cammed downwardly, cutting a shallow thread in the external surface of the reflector and permitting the flange of the reflector, which is now spaced from the ceiling, to be manually grasped and pulled downwardly.

It is accordingly an object of the invention to provide an improved recessed lighting fixture for a hung ceiling installation or the like.

A further object of the invention is the provision of an improved recessed lighting fixture of the type described wherein insertion of the reflector into position and removal thereof is greatly simplified, and wherein a substantial range of heightwise and tilted adjustment of the reflector relative to the ceiling may be effected without compromising the force with which the noted elements are interconnected.

To attain these objects and such further objects as may appear herein or be hereinafter pointed out, reference is made to the accompanying drawings, forming a part hereof, in which.

Figures 1, 2:
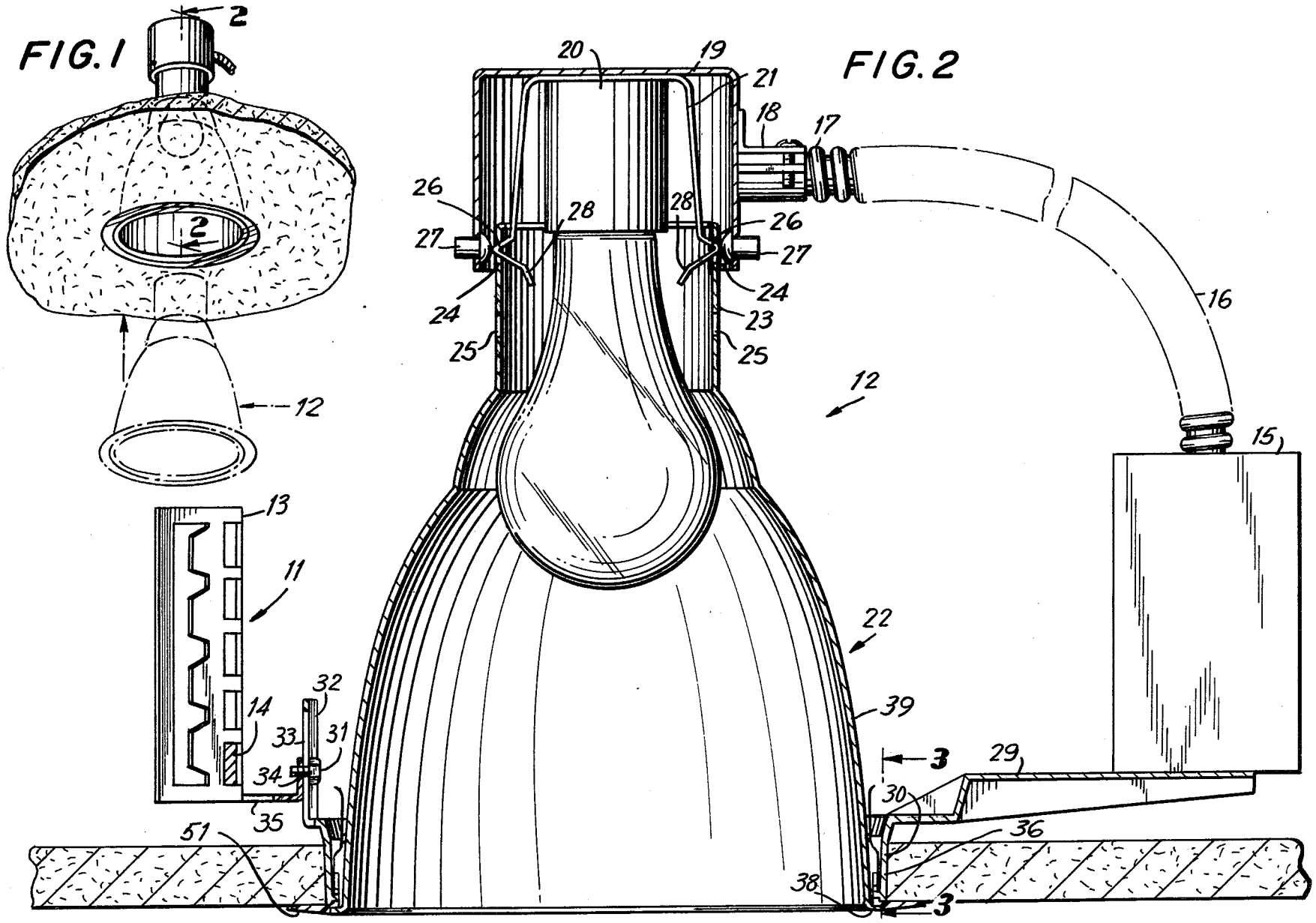
FIG. 1 is an exploded perspective view showing a fixture in accordance with the invention in the environment of a typical hung ceiling installation.
FIG. 2 is a magnified section taken on the line 2—2 of FIG. 1.

In accordance with the invention, the fixture assembly 10 includes a frame component, identified generally as 11, which is mounted to the building structure above the ceiling C, and reflector-light source assembly 12 which is adapted to be removably mounted to the frame 11. The frame 11, the support components of which are essentially conventional, includes a plurality of mounting brackets 13 (one only being shown), which brackets are fixed to straps or crossbars 14 fastened to structural elements above the ceiling assembly.

Suitably mounting brackets and appurtenances are illustrated in U.S. Pat. No. 3,872,296 and, accordingly, further discussion thereof is not considered necessary. The frame assembly 11 carries the usual junction box 15 housing electrical connections to the fixture.

The electrical wiring (not shown) is disposed within a flexible conduit or shield 16, the outer end 17 of which is secured in a cable clamp 18 forming part of the bulb support fixture 19.

The support fixture 19 includes the usual bulb socket 20, and a spring harp 21 or like machanical member which functions to link the reflector 22 to the fixture 19.

The reflector 22 includes an upper cylindrical portion 23 having opposed pairs of slots 24, 24, 25, 25. The harp 21 of fixture 19 includes outwardly sprung detents 26, 26 which may enter one or the other of the sets of opposed slots 24, 25, whereby the reflector is secured to the fixture 19.

The fixture 19 may include release plungers 27, 27 which, when pressed radially inwardly, deflect the detents 26, 26 from the slots to enable removal of the reflector from the socket support fixture. The detents 26 may include inclined cam portions 28 to facilitate insertion of the reflector 22 into position.

The frame 11 includes a base plate or portion 29 terminating in a cylindrical bezel 30. The bezel 30 and base 29 are fixed to the brackets to permit heightwise relative adjustment therebetween, such adjustment being provided by machine screws 31 which extend through vertically directed slots 32 and brackets 33 of the base plate into complemental threaded apertures 34 formed on arms 35 of the brackets 13. Although only one slot and screw connection has been shown, it will be appreciated that a number of such structures are provided.

The cylindrical bezel 30 extends downwardly through a complemental aperture 36 formed in the ceiling C. While the lowermost edge of the bezel is shown in the illustrations as being precisely flush with the under surface of ceiling, in practice such ideal adjustment is not always accomplished. Where there exists a heightwise misadjustment, and where the reflector 22 is constrained to occupy a predetermined heightwise position relative to the support assembly, as is the case with conventional ceiling fixtures, it will be readily recognized that the inaccuracies of installation of the bezel are carried over to the reflector.

In accordance with the attachment assembly next to be described, the heightwise adjustment of the bezel and reflector may be varied within relatively wide limits without compromising the security with which the reflector assembly is supported to the frame. This connector assembly, which comprises the principal advance of the present invention, includes a plurality of spring fingers 37, four such fingers being preferred. The fingers are secured to the bezel 30 and, in their relaxed position, project inwardly to intrude into the vertical space above the mouth portion or aperture 38 of the bezel and into the path of the inclined sides 39 of the reflector.

Figure 3:
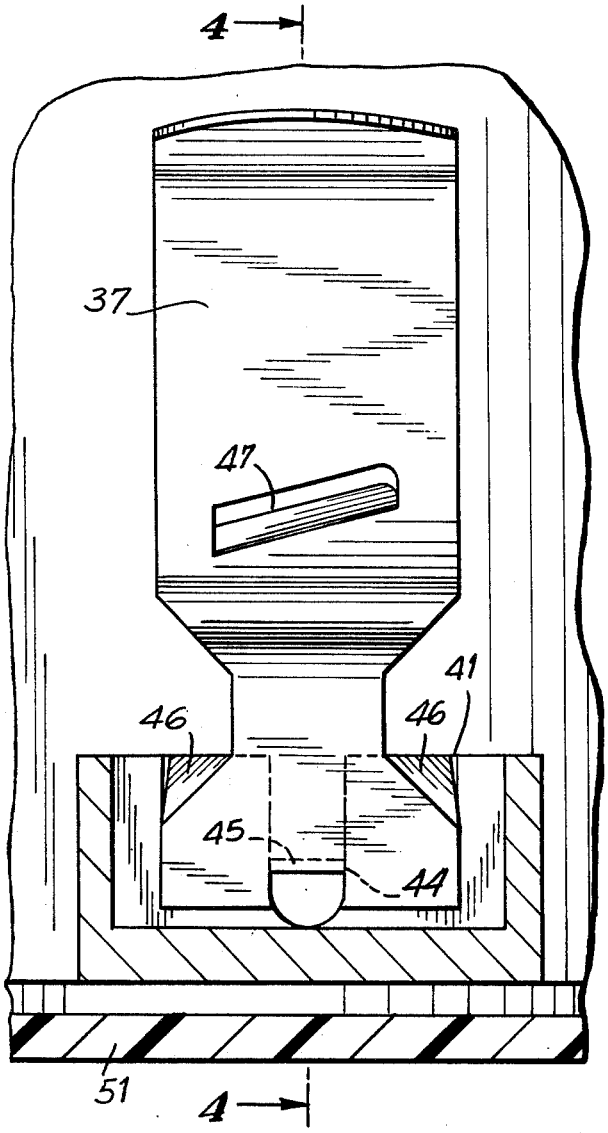
FIG. 3 is a further magnified fragmentary section taken on the line 3—3 of FIG. 2.
Figure 4:
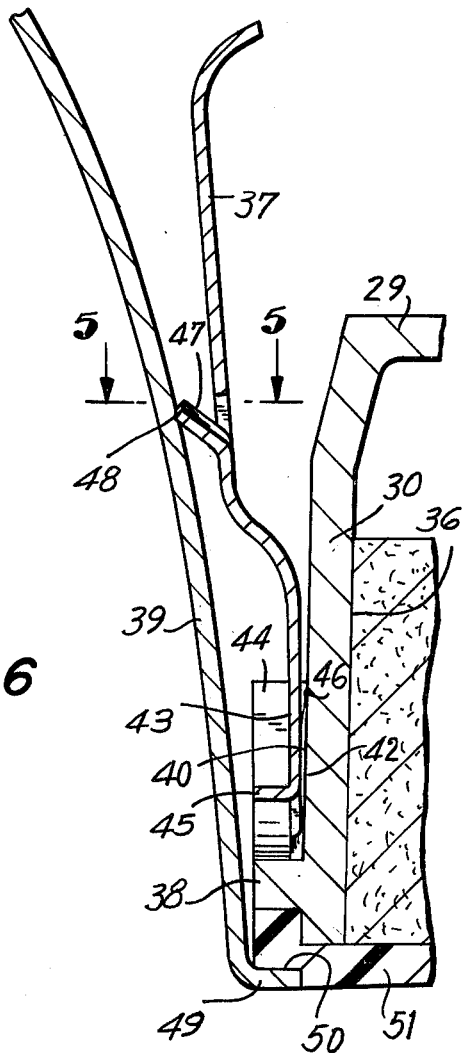
FIG. 4 is a section taken on the line 4—4 of FIG. 3.
Figure 5:
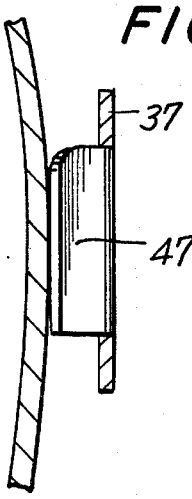
FIG. 5 is a horizontal section taken on the line 5—5 of FIG. 4.
Figure 6:
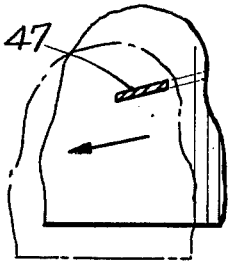
FIG. 6 is a fragmentary sectional view illustrating the position of a portion of the reflector assembly following initial rotary movements for removal.

Referring more particularly to FIGS. 3 and 4, the lower ends 40 of the springs 37 are mounted within pockets 41 formed at angularly spaced positions about the inner circumference of the bezel. The pockets 41 include spaced parallel walls 42, 43, the wall 43 incorporating a vertical centering slot 44.

The spring fingers 37 include, adjacent the lower ends thereof, a centering tongue 45 which, in the mounted position, is disposed within the vertical slot 44 to prevent tilting of the springs relative to the pockets. Deflected barb portions 46, 46 project to the opposite side of the springs 37 from tongue 45. The springs 37 are made of hardened resilient material, such as spring steel.

From the foregoing description it will be understood that the springs are mounted within the pockets 41 by forcing the same downwardly into the pockets, whereby the barb portions 46 are compressed into the uppermost ends of the pockets and will embed themselves into the softer die cast metal of which the frame is formed, precluding their subsequent upward removal from the pockets.

Each of the springs 37 includes a lip 47, the lips 47 coacting with external surface portions of the reflector 22 to achieve the desired mounting of the reflector in position.

As best seen in FIGS. 3 to 6, the lips 47 are inclined to the horizontal, defining in essence short segments of a helix. The pitch of the lips is, in all cases, essentially the same and the lips are aligned at the same height relative to the bezel.

By virtue of the inclination of the lips 47, it will be recognized that each said lip acts as an element of a thread or screw. Preferably the lips 47 are so formed as to provide an inwardly facing, sharpened corner portion 48, which corner portion actually contacts the external surface of the reflector. The reflector 22 may include at its lower end portion an outwardly directed flange 49, the flange 49 underlapping an annular recess 50 in a circular mask 51.

The operation of the device will be apparent from the above description.

Specifically, after the frame and bezel assembly has been mounted at a proper height within the ceiling or as near thereto as feasible, the reflector assembly 12 may be moved upwardly from the dot and dash to the solid line position shown in FIG. 1. In the course of such upward movement, the inclined portions 39 of the reflector 22 bear against and outwardly bias the springs 37 by reason of the engagement of the lip portions 47 of the springs with the inclined portion 39. The reflector assembly 12 is continued to be pressed in an upwardly direction until the mask 51 is sandwiched against the ceiling, the under surface of the mask being engaged by the flange 49 of the reflector 22. In view of the gradual nature of the curved surface of the reflector engaged by the lips and the readily deflected nature of the springs, a substantial range of relative upward movement of the components is feasible, and the reflector may be positioned to compensate for irregularities in the ceiling or situations in which, for instance, the bezel is installed at a slightly tilted position. The fact that the bezel is thus tilted does not, in accordance with the present invention, mandate that the reflector also be tilted.

The reflector assembly which, as noted, is made of a softer metal than the springs, preferably aluminum, will be firmly retained in its raised position by the action of the sharpened edge portions 48 of the lips 47 embedding themselves into the sides of the reflector. The retaining force of the lips is such that the reflector could not be manually removed in a downward direction responsive to downward pull, particularly since there is no part of the reflector which might conveniently be gripped to enable substantial downward forces to be exerted. By virtue, however, of the inclined nature of the lips 47 and sharpened edges 48, an initial lowering of the reflector assembly may readily be achieved by simply bodily rotating the entire reflector assembly. A rotary force may readily be applied by pressing the fingers outwardly against the interior surfaces of the reflector. Such rotary force will cause the inclined lips 47 in essence to score or cut a thread on the outer surface of the reflector by reason of the substantially softer nature of the reflector material as compared with the hardened spring material. Such rotation will lower the reflector sufficiently either completely to release the reflector from the springs or to enable the flange 49, which is now spaced from the ceiling, to be gripped and pulled free, especially as the springs now engage a narrower portion of the reflector.

Additionally, the connective force of the springs may be such that continued rotation of perhaps a half turn must be effected before the reflector is sufficiently released from the grip of the lips.

From the foregoing it will be observed that both the removal and replacement of the reflector may be accomplished without aligning slots, detents or components of the parts, and that a gripping force is exerted on the reflector throughout a substantial range of heightwisely displaced relative positions of the parts.

While the principal function of the threading effect above described is to facilitate removal of the reflector from the frame support, it will be understood that in some circumstances a reverse rotation of the parts may be employed to achieve a more intimate seating of the reflector in an upward direction.

It will be readily recognized by those skilled in the art in the light of the foregoing disclosures that variations in structural details may be made without departing from the spirit of the invention. By way of example, the circular mask may be eliminated, the configuration of the springs and lip portions may be varied, etc. Accordingly, the invention is to be broadly construed within the scope of the appended claims.

Having thus described the invention and illustrated its use, what is claimed as new and is desired to be secured by Letters Patent is:

1. A flush mounted ceiling light fixture comprising, in combination, a frame adapted to be mounted above a ceiling, a cylindrical bezel depending from said frame and having a downwardly open circular mouth portion, a plurality of hardened metal spring members having first ends fixed to said frame at mutually angularly spaced positions surrounding said mouth, said spring members inluding free end portions extending inwardly and overlying said mouth portion, said spring members including inwardly facing cutting lip portions adjacent said free ends, said lip portions being inclined to the horizontal and defining segments of helices having substantially the same pitch angle and direction of inclination, said lip portions being spaced equally from the axis of said bezel and being disposed in generally coplanar alignment, a reflector member formed of substantially softer material than said lip portions, said reflector member being circular in transverse section, the diameter of external portions of said reflector being coordinated with the spacing of said lip portions to provide a snug frictional interfit of said lips and external portions, whereby a reflector supported between said lips may be demounted by relative rotation of said reflector and bezel in the direction of inclination of said lip portions.

2. A light fixture in accordance with claim 1 wherein said reflector is comprised of aluminum.

3. A light fixture in accordance with claim 1 and including lighting means at an upper end of said fixture, the lower end of said fixture having a radially outwardly extending flange portion adapted to be disposed adjacent and outwardly lap said ceiling.

4. Apparatus in accordance with claim 3 and including an annular mask portion having a central aperture, the inside diameter of said aperture being greater than the diameter of said reflector but less than the diameter of said flange, whereby said mask is sandwiched against said ceiling by said flange.

5. Apparauts in accordance with claim 1 wherein the said lip portions are inclined upwardly, whereby said reflector may be inserted by axial shifting movement into supported position between said lips.

6. Apparatus in accordance with claim 5 wherein said reflector is conical, upper portions of said reflector being of lesser diameter than lower portions thereof, whereby said lips are cammed apart responsive to said axial upward movement of said reflector.

7. Apparatus in accordance with claim 1 wherein the inwardly facing portions of said lips include sharpened cutting edge portions.

* * * * *